US006124810A

United States Patent [19]

Segal et al.

[11] Patent Number: 6,124,810

[45] Date of Patent: Sep. 26, 2000

[54] METHOD AND APPARATUS FOR AUTOMATIC EVENT DETECTION IN A WIRELESS COMMUNICATION SYSTEM

[75] Inventors: Michael L. Segal, Carlsbad; Franklin P. Antonio, Del Mar; Sue Elam; Judd Erlenbach, both of San Diego; Kathleen R. de Paolo, Solana Beach, all of Calif.

[73] Assignee: Qualcomm Incorporated, San Diego, Calif.

[21] Appl. No.: 09/153,732

[22] Filed: Sep. 15, 1998

[51] Int. Cl.[7] ..... G08G 1/123

[52] U.S. Cl. ..... 340/994; 340/988; 340/905; 340/441; 340/444; 701/200; 701/208; 701/213

[58] Field of Search ..... 340/994, 988, 340/905, 438, 439, 441, 444; 701/200, 208, 213

[56] References Cited

U.S. PATENT DOCUMENTS

| | | | |
|---|---|---|---|
| 4,630,227 | 12/1986 | Hagenbuch | 702/174 |
| 4,791,571 | 12/1988 | Takahashi et al. | 701/117 |
| 4,799,162 | 1/1989 | Shinkawa et al. | 280/28.14 |
| 5,068,656 | 11/1991 | Sutherland | 340/989 |
| 5,260,694 | 11/1993 | Remahl | 340/674 |
| 5,359,528 | 10/1994 | Haendel et al. | 701/35 |
| 5,416,706 | 5/1995 | Hagenbuch | 701/50 |
| 5,493,295 | 2/1996 | Lewiner et al. | 340/994 |
| 5,541,845 | 7/1996 | Klein | 701/207 |
| 5,613,216 | 3/1997 | Galler | 455/66 |
| 5,648,770 | 7/1997 | Ross | 340/994 |
| 5,657,010 | 8/1997 | Jones | 340/994 |
| 5,717,389 | 2/1998 | Mertens et al. | 340/928 |
| 5,751,245 | 5/1998 | Janky et al. | 342/357 |
| 5,808,565 | 9/1998 | Matta et al. | 340/994 |

FOREIGN PATENT DOCUMENTS

| | | |
|---|---|---|
| 9311443 | 6/1993 | WIPO . |
| WO9720190 | 6/1997 | WIPO . |

*Primary Examiner*—Benjamin C. Lee
*Attorney, Agent, or Firm*—Philip R. Wadsworth; Thomas M. Thibault; Gregory D. Ogrod

[57] ABSTRACT

Apparatus and method for determining when a vehicle has arrived or departed from a planned or an unplanned stop, while minimizing or completely eliminating driver intervention. The apparatus comprises a mobile communication terminal located onboard a vehicle for receiving destination information, generally using wireless means, from a central facility or hub. A speedometer also located onboard the vehicle determines the speed of the vehicle and a position sensor onboard the vehicle determines the vehicle position. The vehicle speed and position are provided to a processor, also located onboard the vehicle, which uses the speed and position information to determine a vehicle arrival or departure from a planned or unplanned stop. The processor generates an indication of the event, either arrival or departure, directly to the central facility, to the vehicle operator, or both.

6 Claims, 5 Drawing Sheets

METHOD AND APPARATUS FOR AUTOMATIC EVENT DETECTION IN A WIRELESS COMMUNICATION SYSTEM

BACKGROUND OF THE INVENTION

I. Field of the Invention

The present invention relates generally to wireless communication systems and more particularly to a method and apparatus for automatically detecting vehicle arrival and departure events using a wireless communication system.

II. Description of the Related Art

The use of wireless communication systems is well known for transmitting information between fixed stations and one or more geographically dispersed mobile receivers. For example, satellite communication systems have been used in the trucking industry for many years to provide messaging and location information between fleet-owned dispatch centers and their respective tractor-trailer vehicles. Such systems offer significant benefits to fleet owners because they allow almost instantaneous communications and real-time position information. In addition, many such systems provide remote monitoring of the performance characteristics of each fleet-owned vehicle, such as the average speed, RPM, and idle time of each vehicle. An example of such a satellite communication system is disclosed in U.S. Pat. No. 4,979,170 entitled "ALTERNATING SEQUENTIAL HALF DUPLEX COMMUNICATION SYSTEM AND METHOD", U.S. Pat. No. 4,928,274 entitled "MULTIPLEXED ADDRESS CONTROL IN A TDM COMMUNICATION SYSTEM", and U.S. Pat. No. 5,017,926 entitled "DUAL SATELLITE NAVIGATION SYSTEM", assigned to the assignee of the present invention and incorporated by reference herein.

In the satellite communication system described by the above-mentioned patents, fleet-owned dispatch centers communicate using land-based systems such as telephone or fiber-optic networks to a hub, otherwise known as a network management facility (NMF). The NMF acts as a central communication station through which all communications between vehicles and dispatch centers pass. The NMF comprises a number of network management computers (NMCs), each NMC responsible for providing a communication path from the NMF to geographically dispersed vehicles in the communication system using a geosynchronous satellite. The geosynchronous satellite comprises one or more transponders, which are electronic circuits well known in the art for relaying high frequency satellite communication signals between remote locations. Each NMC is assigned an individual transponder, each transponder operating at a unique frequency in order to avoid interference with communication signals on other transponders. In the satellite communication system of the above-referenced patents, each transponder is capable of handling the communications needs of approximately 30,000 vehicles.

Each vehicle in the communication system is equipped with a transceiver, otherwise known as a mobile communication terminal (MCT), for communicating message and location information to a pre-designated NMC via the geosynchronous satellite. The MCT typically also comprises an interface device which displays text messages to one or more vehicle occupants and accepts either voice or text messages to be transmitted to the vehicle's fleet-owned dispatch center. Furthermore, the MCT may further comprise a digital processor which communicates with one or more Electronic Control Units (ECUs) located at various points throughout the vehicle. Each ECU provides information relating to the operational performance of the vehicle to the digital computer indicating characteristics including, but not limited to, vehicle speed, engine RPM, and miles traveled.

The wireless communication system described above allows vehicle occupants to easily contact their respective dispatch centers in order to keep fleet personnel apprised of various events throughout a typical delivery cycle. For example, upon arrival at a predetermined pickup destination, a truck driver may contact a dispatch center associated with the vehicle to alert fleet personnel of the time and location of the arrival. Similarly, after the truck has been loaded at the pickup destination, the driver may send a message to the dispatch center indicating the time of departure, the location from where the departure occurred, and a description of the goods that is being transported. Another example where a vehicle operator might transmit a status message to the dispatch center is when an unscheduled stop has been made and/or when the vehicle departs from the unscheduled stop.

Although communications between drivers and dispatch centers have been made much more convenient and reliable using satellite or terrestrial-based communication systems, a variety of problems persist in the reporting process. For example, a driver may forget to send a message upon arrival or departure from a planned pickup destination, causing confusion at the dispatch center as to the status of goods in transit. Or, a driver may send a message long after he has departed a pickup indicating that he is just now leaving the pickup location, to avoid possible negative consequences of forgetting to send a timely message. Furthermore, a driver may not wish to inform the dispatch center when making an unscheduled stop, for a variety of reasons.

The dispatch center relies heavily on driver messages for maximizing fleet efficiency. Therefore, a system is needed that can determine the status of a vehicle in transit without driver intervention. The system should be able to distinguish several different kinds of events, such as arrivals and departures from planned and unplanned stops.

SUMMARY OF THE INVENTION

The present invention is an apparatus and method for determining the status of a vehicle in transit. In particular, the present invention determines if a vehicle has arrived or departed from a planned or an unplanned stop, while minimizing or completely eliminating the need for driver intervention.

In accordance with one embodiment of the present invention, an apparatus for determining vehicle arrivals and departures comprises a mobile communication terminal located onboard the vehicle for receiving destination information, generally using wireless means from a central facility or hub. A speedometer also located onboard the vehicle determines the speed of the vehicle and a position sensor onboard the vehicle determines the vehicle position. The vehicle speed and position are provided to a processor, also located onboard the vehicle, which is connected to the mobile communication terminal, the speedometer, and the position sensor. The processor uses the vehicle speed provided by the speedometer, the position information provided by the position sensor, a time indication, and a vehicle status to determine whether the vehicle has arrived or departed from a planned stop specified by the destination information. The processor generates an indication of the event, either an arrival or a departure from a planned stop, and provides the indication directly to the central facility, to the vehicle operator, or both. In addition, the processor can determine when the vehicle has made an unplanned stop and when the vehicle departs from the unplanned stop.

In accordance with another embodiment of the present invention, a method for determining vehicle arrivals and departures comprises generating destination information at a central facility and transmitting the destination information to a vehicle equipped with a mobile communication terminal. The vehicle speed and position is determined onboard the vehicle and used in conjunction with the received destination information by a processor to determine whether the vehicle has arrived at or departed from a planned stop, as specified by the destination information. The processor generates an indication of the event, either an arrival or a departure at a planned stop, and provides the indication to the central facility, to the vehicle operator, or both. In addition, the processor can determine when the vehicle has made an unplanned stop or a departure from the unplanned stop.

BRIEF DESCRIPTION OF THE DRAWINGS

The features, objects, and advantages of the present invention will become more apparent from the detailed description set forth below when taken in conjunction with the drawings in which like reference characters identify correspondingly throughout and wherein.

DESCRIPTION OF THE PREFERRED EMBODIMENTS

The present invention is an apparatus and method for determining the status of a vehicle in transit. In particular, the present invention determines if a vehicle has arrived or departed from a planned or an unplanned stop, while minimizing or completely eliminating the need for driver intervention. The invention is described in the context of a satellite-based mobile communication system used in the trucking industry. However, it should be understood that the present invention may be used in other wireless communication systems such as cellular, PCS, or GSM terrestrial-based systems and can be used in other transportation vehicles, such as passenger vehicles, railcars, marine vessels, or airplanes. Furthermore, the present invention is not limited to use on or in vehicles, but can also be placed inside a package, worn as a personal monitoring device, or used in any situation for which it is desirable to determine whether or not an arrival or a departure has occurred.

Figure 1:
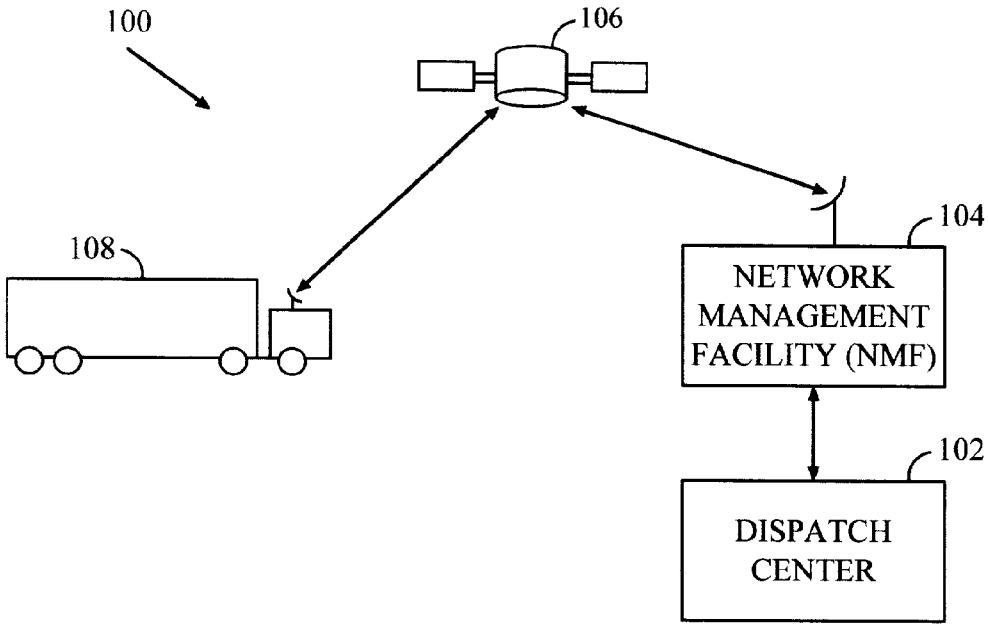
FIG. 1 is an illustration of a satellite communication system in which the present invention is used.

FIG. 1 is an illustration of a satellite communication system in which the present invention is used. Shown is satellite communication system 100, comprising a dispatch center 102, a Network Management Facility (NMF) 104 (otherwise known as a central facility or hub), a communication satellite 106, and a vehicle 108. Communications in the form of text and voice messages are transmitted between dispatch center 102 and vehicle 108 using NMF 104 and communication satellite 106. A transceiver, or mobile communication terminal (MCT) (shown in FIG. 2), within vehicle 108 allows messages to be transmitted and received by vehicle 108 as it travels throughout a large geographical area within the coverage area of satellite 106. The MCT is well known in the art for providing wireless communications between vehicles and a central station. A second transceiver (also not shown) is located within NMF 104 which allows communications to be transmitted and received by NMF 104. Only one vehicle 108 is shown in the communication system of FIG. 1 for purposes of clarity. In an actual communication system, a large number of vehicles, each equipped with an MCT, is present in the system. Similarly, although only one dispatch center 102 is shown in FIG. 1, in practice, many dispatch centers may be linked to NMF 104, each dispatch center able to communicate with their corresponding fleet of vehicles through NMF 104 and satellite 106.

One of the many functions of dispatch center 102 is to coordinate the activities of its fleet of vehicles in order to maximize efficiency and minimize costs. As part of that coordination, information for each fleet-owned vehicle is generated by dispatch center 102 and transmitted to the respective vehicle. The information transmitted to the vehicles, known as a "load assignment" or, more generically, destination information, comprises one or more predetermined travel routes, along with other information as well. The travel routes typically include one or more planned stops, for example, pick up and delivery destinations, at which a given vehicle is to stop and transact business. The destination information typically contains additional information regarding the travel route and planned stops including the actual map coordinates, i.e., latitude and longitude, for each planned stop, an expected time of arrival and/or departure for each planned stop, the average travel time between stops, rush hour and traffic information, and weather information. Generally, destination information may comprise any information generated by dispatch center 104 which facilitates the control or monitoring of vehicle 108. Typically, the stops are planned such that each vehicle's delivery route maximizes efficiency and, thus, minimizes costs for fleet management. The destination information is transmitted to vehicle 108 using NMF 104 and satellite 106. The information is received by an MCT onboard vehicle 108 and generally stored in a memory for use by automated onboard electronic systems and/or by the vehicle operator. In a typical application, the destination information may be displayed at any time by the vehicle operator using a display device connected to the MCT. After viewing the destination information, the vehicle operator may then proceed along the calculated travel route provided by dispatch center 102. The route information directs the vehicle operator to travel to the first destination for a pick up or delivery, to the next destination, and so on. Using the present invention, as each destination is reached, an indication of the arrival and/or departure of the vehicle is generated to alert dispatch center 102 of the event.

Figure 2:
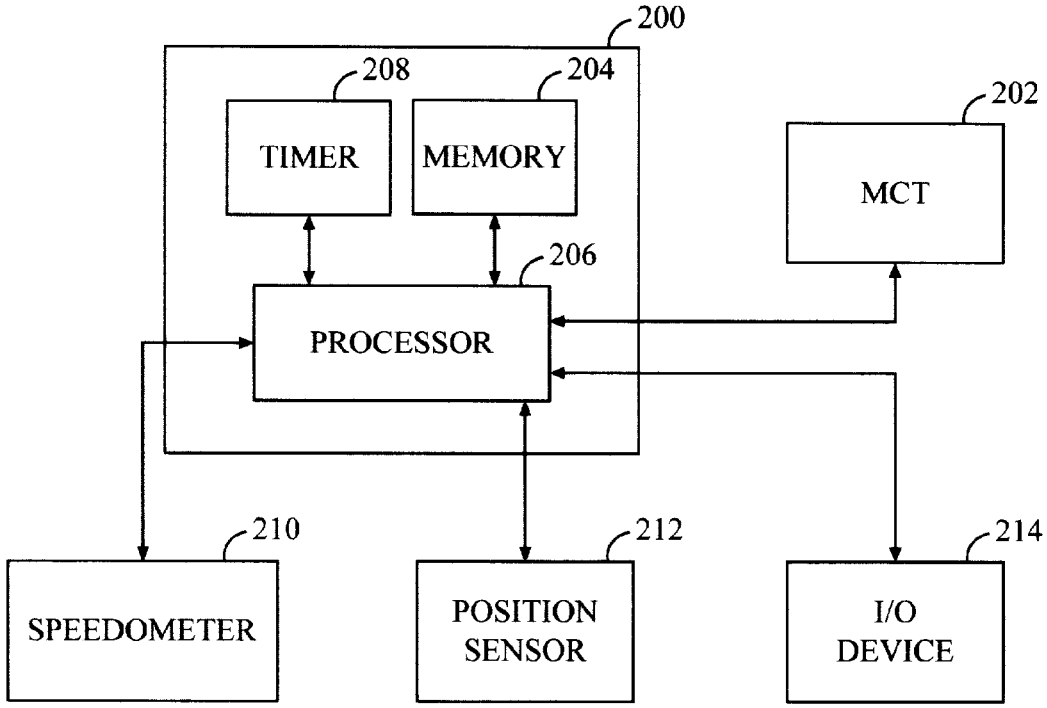
FIG. 2 illustrates the components used for automatically determining vehicle arrivals and departures from planned and unplanned stops in accordance with the present invention.

FIG. 2 illustrates the components used for automatically determining vehicle arrivals and departures from planned and unplanned stops in accordance with the present invention. In the exemplary embodiment, all components are located onboard vehicle 108, however, in other embodiments, one or more of the components may be located remotely from the vehicle. For example, the vehicle position might be determined at NMF 104 using the positioning system described in U.S. Pat. No. 5,017,926 entitled "DUAL SATELLITE NAVIGATION SYSTEM," assigned to the assignee of the present invention and incorporated by reference herein. In such a system, the vehicle position is determined at NMF 104, then transmitted to vehicle 108 for use in subsequent calculations.

As shown in FIG. 2, onboard computer (OBC) 200 comprises memory 204 and timer 208, connected to processor 206. Although these components are shown in FIG. 2 as being part of OBC 200, each component, or a combination of components, may be physically isolated from each other while continuing to operate together using wire or wireless means. Timer 208 is shown as an individual component of OBC 200, but could alternatively be integrated into processor 206 if desired. Processor 206 is additionally connected to MCT 202, speedometer 210, position sensor 212, and I/O device 214. MCT 202 is located onboard vehicle 108 and allows communications to take place between vehicle 108 and NMF 104.

MCT 202 contains circuitry well known in the art for receiving modulated RF signals, including destination information transmitted NMF 104 using satellite 106, and providing the destination information to processor 206. Processor 206 manages one or more computational functions onboard vehicle 108, and typically comprises one or more digital microprocessors well known in the art, such as any of the x86 family of microprocessors from Intel, Incorporated of Santa Clara, Calif. Coupled to processor 206 is memory 204 which may contain areas for data storage, as well as programs, maps, databases, and other information required by processor 206 to perform its functions. Memory 204 may comprise one or more random access memories (RAM), one or more CD-ROMs, a removable memory device or any other device that allows storage and retrieval of data. In addition, memory 204 may be a separate or an integral component of OBC 200.

Generally, the destination information received by processor 206 is stored in memory 204 for later use. Destination information is considered to be "active" within memory 204 if the travel route contained within the destination information has yet to be completed by vehicle 108. Memory 204 stores the destination information for later use by other onboard devices. For example, destination information may be retrieved by processor 206 when needed for parametric calculations. Or, I/O device 214 may request all or a portion of the destination information upon request by the vehicle operator, for example, to view the destinations along the route to which the vehicle has been assigned.

Position sensor 212 determines the position of vehicle 108 as it is operated along its route. The position information is provided to processor 206 for use in subsequent calculations. In the exemplary embodiment, position sensor 212 comprises a GPS receiver capable of receiving positioning signals from one or more NAVSTAR GPS satellites in geostationary earth orbit. Generally, position data from the GPS receiver is calculated on a continuous basis. It should be understood that other position determining systems can alternatively be used in place of the GPS positioning system, such as a land-based LORAN-C positioning system, a space-based GLONASS system, or a dead reckoning system which uses a vehicle heading and travel distance to determine vehicle position.

Depending on the type of position sensor 212 used, position information is calculated either continuously, at predetermined time intervals, or whenever polled by processor 206. In the exemplary embodiment, position information is provided to processor 206 once every five seconds.

Speedometer 210 is used to determine the speed of vehicle 108 during operation. Speedometer 210 may be either an analog or a digital device, coupled to processor 206 for reporting the instantaneous speed of vehicle 108 as it travels along its route. In the case of an analog speedometer, an analog-to-digital conversion may be required prior to the information reaching processor 206. Speedometer 210 generally monitors the vehicle wheel revolutions per time period to calculate the vehicle speed, although other methods known in the art may be used instead.

Processor 206 uses the vehicle speed information from speedometer 210, the position information from position sensor 212, and the destination information from either memory 204 or directly from MCT 202 to detect an arrival or a departure from a planned stop. The location of planned stops are contained within the destination information, represented generally by latitude and longitude coordinates, although other representations may be used. Arrivals and departures from unplanned stops may also be determined by processor 206, as explained below.

In order to determine arrivals and departures, processor 206 first determines which of several states vehicle 108 is operating in. In the exemplary embodiment, five states are identified, including an "unassigned" state, an "awaiting movement" state, an "enroute" state, an "at a planned stop" state, and an "at an unplanned stop" state. The state of vehicle 108 is generally stored in memory 204 for use in later processing. The five vehicle states are described in detail below.

Generally, the "unassigned" state refers to when vehicle 108 is not required to perform a task for fleet management. For example, this state is assigned by processor 206 to vehicle 108 if no active destination information is stored in memory 204. As explained previously, destination information is received by MCT 202 and stored in memory 204. As vehicle 108 follows the travel route prescribed by the destination information, various updates to the destination information are provided to memory 204. For example, as each planned stop is arrived at or departed from, processor 206 may assign a different vehicle state to vehicle 108. In another example, processor 206 tracks the planned stops which have been reached and those stops that have not. Updates might further include modifications to the original destination information, such as additional planned stops, which supercede the active destination already stored in memory 204.

When the travel route has been completed, for example the vehicle has arrived at the final destination in the travel route, processor 206 assigns the "unassigned" state if no other destination information has been received by MCT 202. The unassigned state is also assigned by processor 206 for a vehicle 108 which has been placed into service for the first time prior to receiving any destination information. When a vehicle 108 is equipped with OBC 200 for the first time, generally no destination information is present in memory 204, and processor 206 assigns the "unassigned" state to vehicle 108.

The "awaiting movement" state is assigned by processor 206 to vehicle 108 after destination information is received by MCT 202 and before vehicle 108 has moved from the position at which it received the destination information. When destination information is received by MCT 202, a vehicle position is determined using position sensor 212.

The position information may be stored in memory 204, transmitted to dispatch center 102, displayed to a vehicle occupant using I/O device 214, or any combination of the above actions. In the exemplary embodiment, movement is defined as when the distance between a present vehicle position and the vehicle position at which the destination information was received is greater than a predetermined distance. The predetermined distance may be programmable locally, for example, by a vehicle operator, or, more likely, remotely by fleet dispatch personnel using wireless communication techniques. The present invention provides for over-the-air programming of this and other user-defined thresholds. The predetermined distance, as well as other user-defined variables, are stored in memory 204 and can be changed, generally, at any time.

Movement may also be defined in other ways as well. For example, for purposes of detecting movement while in the "awaiting movement" state, motion can be defined as when the speed of vehicle 108 exceeds a predetermined threshold speed, or a motion sensor onboard vehicle 108 detects movement of the vehicle, or a combination of both. In the exemplary embodiment, movement is defined as when vehicle 108 has traveled more than one mile from where the destination information was received.

The "enroute" state is assigned to vehicle 108 by processor 206 if active destination information is stored in memory 204 and vehicle 108 is moving. This state is most frequently assigned following the "awaiting movement" state described above. For purposes of the "enroute" state, movement can be defined in any of the ways described above. It can be further defined, for example, by defining movement as only including movement toward one of the defined stops along the travel route, i.e., position reports indicating a, chronological decrease in distance to the next planned stop. Furthermore, movement may be defined as only movement toward one of the planned stops in sequential order. The enroute state can also be assigned by processor 206 to a vehicle in the "unassigned" state if the vehicle is moving while it receives destination information. In this case, the "awaiting movement" state is bypassed. Movement in this case is defined as the vehicle traveling more than a predetermined speed for more than a predetermined amount of time, although alternative methods can be used instead. In the exemplary embodiment, the predetermined speed is 2 miles per hour and the predetermined time is twenty seconds.

The "at a planned stop" state represents vehicle 108 having arrived it a destination matching one of the planned stops in a travel route stored in memory 204. This state is assigned by processor 206 to vehicle 108 immediately after determining that vehicle 108 has arrived at one of the planned stops along the travel route. The method by which processor 206 determines the vehicle arrival is described in detail below. The "at a planned stop" state is maintained until vehicle 108 enters the "enroute" state upon detection of vehicle movement, or enters the "unassigned" state if no further destinations are present in the travel route, for example, when vehicle 108 has completed the travel route assigned by dispatch center 102.

The "at an unplanned stop" state is assigned to vehicle 108 by processor 206 when vehicle 108 has stopped at a location other than one of the planned stops contained in memory 204. Such stops may include fuel stations, truck stops, rest stops, motels, etc., but generally do not include stops at red lights, or stops due to heavy traffic conditions, i.e., "stop-and-go" traffic. Arrivals to and departures from unplanned stops are described in more detail, below.

Figure 3:
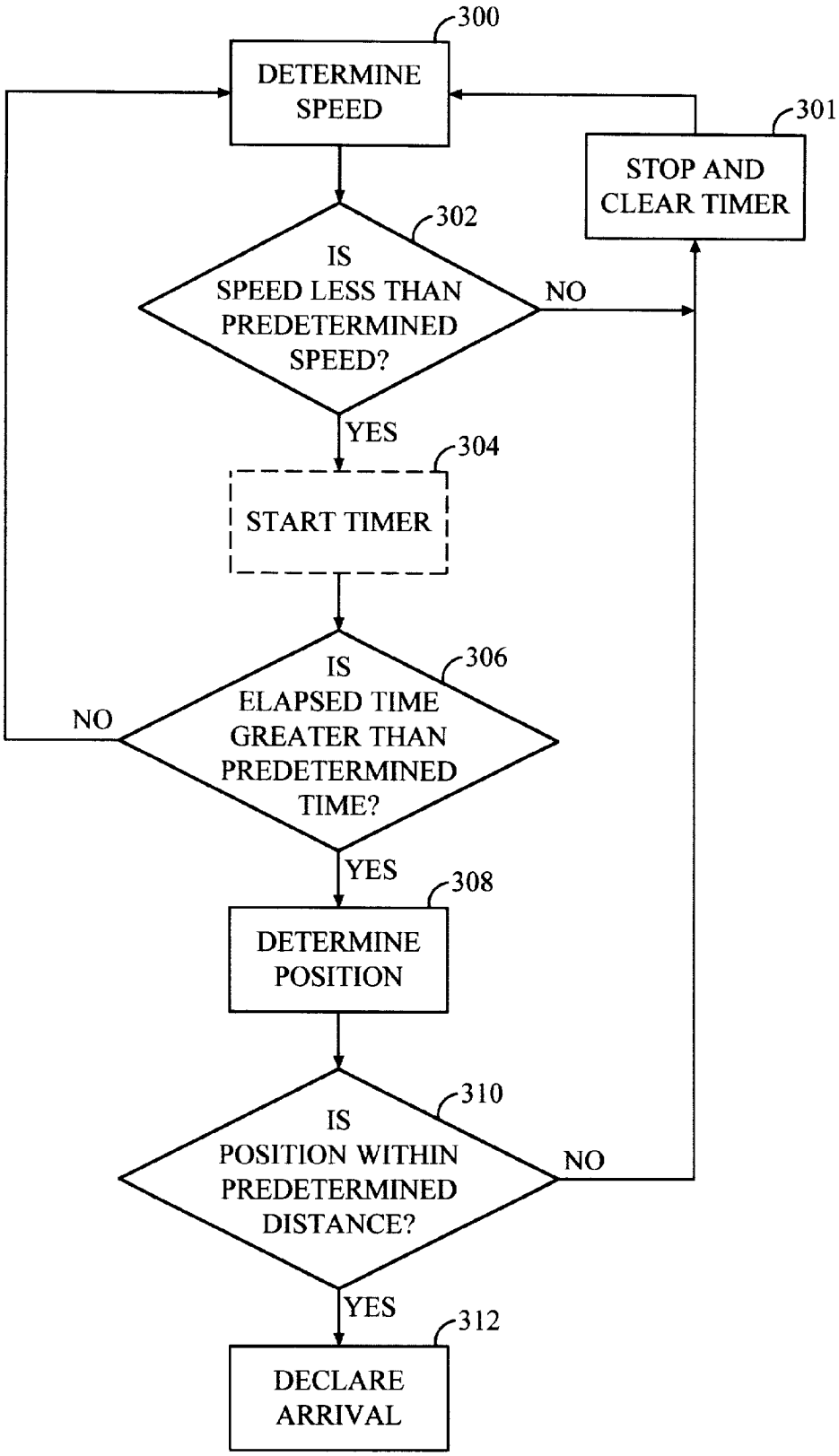
FIG. 3 is a flowchart detailing the steps that are performed to determine if a vehicle has arrived at a planned stop.

FIG. 3 is a flowchart detailing the steps that processor 206 performs to determine if vehicle 108 has arrived at a planned stop, i.e., one of the planned stops along the travel route that is stored in memory 204. In the exemplary embodiment, the steps of FIG. 3 are only carried out by processor 206 if the current vehicle state is in the "enroute" state. However, in other embodiments, the steps of FIG. 3 may be performed continuously or in response to predefined events, depending on the specific application.

Referring again to FIG. 3, processor 206 receives information from speedometer 210 to determine the speed of vehicle 108 in step 300. The present vehicle speed is then compared to a predetermined speed in step 302 to determine if vehicle 108 has slowed significantly or has stopped. The reduced speed of vehicle 108, combined with the proximity to a planned stop (described below), is indicative that vehicle 108 is nearing or has arrived at one of the planned stops along the travel route. The predetermined speed is stored in memory 204 and may be configured locally by a vehicle occupant, technician, or mechanic, or remotely by fleet management. In the case of local configuration, the predetermined speed may be entered using I/O device 214. In the case of remote configuration, the predetermined speed is transmitted from dispatch center 102 by way of NMF 104 and satellite 106 to MCT 202. In either case, the predetermined speed is stored in memory 204 along with other user configurable variables, described in greater detail later herein.

In the exemplary embodiment, the predetermined speed is five miles per hour. If the vehicle speed is greater than the predetermined speed, timer 208 is halted and cleared in step 301, if it had previously been activated. Timer 208 is used to determine how long the vehicle speed remains below the predetermined speed. Steps 300, 301, and 302 are then repeated until the vehicle speed is less than the predetermined speed.

If the vehicle speed is less than the predetermined speed as determined in step 302, timer 208 is started in step 304. The longer that the speed of vehicle 108 remains below the predetermined speed, the greater the probability that vehicle 108 has arrived at a planned stop, and the less likely the slowdown is due to some other event, such as a traffic delay. It should be understood that step 304 is only performed if timer 208 was previously stopped or had not been started.

In step 306, the elapsed time provided by timer 208 is compared to a predetermined time to determine if the speed of vehicle 108 has remained below the predetermined speed for the predetermined time period. If not, step 300 is performed, after a predetermined delay, in which the present speed of vehicle 108 is determined once again. In the exemplary embodiment, the predetermined delay is 15 seconds. In other embodiments, no delay is used. The steps of 300, 302, and 306 are repeated until step 306 indicates that the speed of vehicle 108 has remained below the predetermined speed for the predetermined time period. The predetermined time period is user configurable, like the previously discussed speed variable, and can be altered locally or remotely in a similar fashion. The predetermined time is stored in memory 204.

When the vehicle speed has remained less than the predetermined speed for greater than the predetermined time, step 308 is performed. In step 308, processor 206 receives information from sensor 212 to determine the current vehicle position. The vehicle position may be determined at predefined intervals of time, such as once every five seconds in the exemplary embodiment, or each time vehicle 108 travels a predetermined distance as indicated by an odometer or hubometer generally found on most vehicles.

The vehicle position may also be determined at predefined events, such as when a vehicle ignition is turned "on" or "off," or any time a message is transmitted by a vehicle occupant. Any one or a combination of the just described events may be used to determine when a vehicle position is determined by processor 206, limited only by the ability of processor 206 to perform all of the other processing tasks which it is tasked.

Once the vehicle position has been determined in step 308, step 310 is performed by processor 206 which determines whether or not vehicle 108 is within a predetermined distance from any of the planned stops defined in the destination information stored in memory 204. In another embodiment, processor 206 only determines whether or not vehicle 108 is within a predetermined distance from the next planned stop along the travel route stored in memory 204.

Processor 206 determines whether or not vehicle 108 is within the predetermined distance from a planned stop by comparing the current vehicle position to each planned stop position contained within memory 204 and computing the distance between the two. Generally, the vehicle position and the planned stop positions are presented to processor 206 as latitude and longitude coordinates. The straight-line distance between two points is then a matter of geometric calculation which is well known in the art. The distance between the current vehicle position and a planned stop may be further refined by using other methods. For example, instead of using the straight-line distance calculation, a calculation which takes into account the curvature of the earth may also be used. This calculation, called the great circle distance, is well known in the art for determining the true travel distance between two points on earth. Yet another method for determining distance between the vehicle present position and a planned stop is by using actual miles between landmarks nearby the vehicle position and the planned stop position. Landmarks can include highway intersections, country or state boundaries, cities, towns, etc. Actual mileage between landmarks is widely available in both print and electronic form, the latter being stored in memory 204 and used by processor 206 to approximate the distance between positions. This is done by approximating the travel route of vehicle 108 with highway segments having known distances between segment endpoints. The segment distances are added together by processor 206 to determine the approximate differential distance between the present vehicle position and the planned stop.

The predetermined distance found in step 310 is a number which is configurable locally by a vehicle occupant, technician, or mechanic or remotely by fleet management, as described above. The predetermined distance is stored in memory 204 and is equal to one mile in the exemplary embodiment. Again, memory 204 may be a single memory device onboard vehicle 108 or several independent memory devices, each of the independent memory devices for storing particular types of data. For example, one memory device may store an executable program while another may store all of the user-changeable variable.

If vehicle 108 is not within the predetermined distance from one of the planned stops in the destination information, step 301 is performed in which timer 208 is stopped and cleared. Then, the speed of vehicle 108 is again determined in step 300, and the process repeats. Typically, a time delay is used before the next speed determination in step 300 is performed. In the exemplary embodiment, the time delay is 15 seconds. In other embodiments, no time delay is used.

When step 310 is completed successfully, that is, the position of vehicle 108 is within a predetermined distance from one of the planned stops in the destination information, vehicle 108 is deemed to have arrived at a planned stop. Upon arrival at a planned stop, step 312 is performed by processor 206, which initiates one or more actions in response to the arrival. For example, the destination information stored in memory 204 is updated to reflect the arrival at the planned stop to which vehicle 108 is closest and the vehicle status is changed from "enroute" to "arrived at a planned stop" and is stored in memory 204. Other actions may be taken as well. For example, processor 206 may send an alert to I/O device 214 indicating to a vehicle occupant that an arrival at a planned stop has been determined. The estimated departure time, the estimated position of the unplanned stop, may also be provided to I/O device 214. Alternatively, or in addition, a message may be transmitted automatically to dispatch center 102 alerting fleet management of the arrival of vehicle 108 from a planned stop and any details associated therewith. In another embodiment, an automated message is not sent until a vehicle occupant has given authorization for the automatic message to be transmitted using I/O device 214. In another embodiment, the vehicle occupant, in response to an alert sent from processor 206 to I/O device 214, transmits a user-generated message using MCT 202 to fleet management, informing them of the precise details of the arrival, for example, the time of the arrival, the location of the stop, or the goods being pickup up or delivered.

If processor 206 incorrectly determines an arrival, for example the vehicle is still in transit and not near any planned stop, a vehicle occupant can choose to ignore the indication. In another embodiment, if no response is entered by a vehicle occupant, processor 206 can send a message to fleet management at dispatch center 102 alerting them to the arrival and provide pertinent details such as the vehicle position, a description of the planned stop, and the time of arrival. In yet another embodiment, an automated log located onboard vehicle 108 or remotely at NMF 104 or dispatch center 102 can be updated with the arrival information. Automated logs are becoming a popular way for vehicle operators to comply with governmental regulations, such as the United States Department of Transportation (DOT) highway regulations, rather than using manually generated paper logs, which tend to be error prone and complex.

Figure 4:
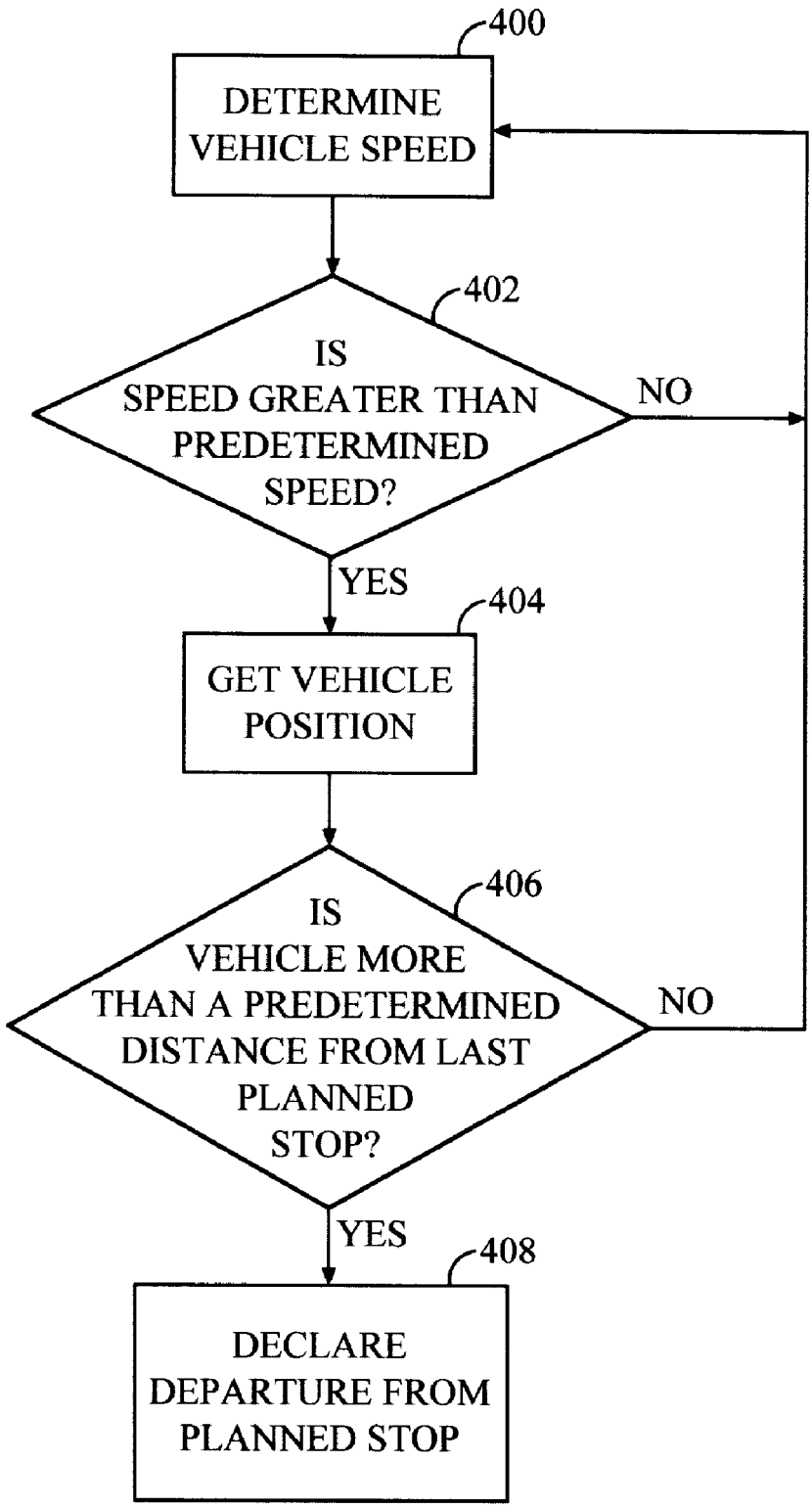
FIG. 4 is a flow diagram illustrating the steps that are performed to determine if a vehicle has departed from a planned stop.

FIG. 4 is a flow diagram illustrating the steps that processor 206 performs in order to determine whether or not a vehicle has departed from a planned stop. In the exemplary embodiment, the steps of FIG. 4 are performed only when vehicle 108 is in the "at a planned stop" state. However, it is contemplated that processor 206 could perform the steps of FIG. 4 in other vehicle states. In another embodiment, the steps of FIG. 4 could be performed at predetermined times or in response to predetermined events, without the use of vehicle states.

To determine when vehicle 108 has departed from a planned stop, processor 206 receives speed information for vehicle 108 from speedometer 210 in step 400, either continuously or at predetermined time intervals. Alternatively, speed information can be provided to processor 206 from speedometer 210 in response to a predefined event such as the passage of time from when a vehicle ignition is turned "on." Once the vehicle speed has been determined by processor 206, the speed is compared to a predetermined speed in step 402 to determine if the vehicle is presently moving or not. The predetermined speed in this scenario is a different and distinct variable from the predetermined speed variable used to determine whether or not vehicle 108 has arrived at a planned stop, as explained above. If the vehicle speed is greater than the predetermined speed, the vehicle is determined to be moving and step 404 occurs next. If the vehicle speed is not greater than the predetermined speed, steps 400 and 402 are repeated until the vehicle speed exceeds the predetermined speed.

The current vehicle position is next determined in step 404 using position sensor 212. Processor 206 receives position information from position sensor 212 to determine the current vehicle location. Alternatively, position sensor 212 provides a current vehicle position to processor 206 in response to a predefined event. The vehicle position is generally determined immediately after step 402 is successfully completed, i.e., immediately after the vehicle speed is greater than the predetermined speed. However, an immediate position determination is not crucial to the functionality of the present invention. As long as the vehicle position is determined within a reasonable amount of time after the vehicle speed exceeds the predetermined speed, for instance five minutes, processor 206 will be able to correctly estimate whether or not vehicle 108 has departed from a planned stop.

In step 406, the distance between the current vehicle position determined in step 404 and the map coordinates of the last planned stop that vehicle 108 was determined to have been at is compared to a predetermined distance. In another embodiment, the position of vehicle 108 at the time that an arrival at a planned stop was determined can be substituted for the map coordinates of the last planned stop that vehicle 108 was determined to have been at. The predetermined distance used in step 406 is a variable that may or may not be equal to the predetermined distance used to calculate arrivals as explained in step 302 of FIG. 3. However, like the predetermined distance used to calculate arrivals, the predetermined distance in step 406 is programmable locally or remotely, and is stored in memory 204, as explained above.

The distance between the current vehicle position and the last planned stop that vehicle 108 was determined to have been at can be measured using one of several alternative methods described above, including straight-line methods, the great circle distance as explained previously, or actual distances based on landmarks. If the distance between the current vehicle position and the last planned stop that vehicle 108 was determined to have been at is greater than the predetermined distance, as determined in step 406, the vehicle is determined to have departed from the last planned stop. If the distance between the vehicle position and the last planned stop position is not greater than the predetermined distance, step 400 is repeated, in which the speed of vehicle 108 is determined once again.

When step 406 is completed successfully, it indicates that vehicle 108 has departed from a planned stop. Upon processor 206 detecting the departure, step 408 is performed, which initiates one or more actions in response to the departure. For example, the destination information stored in memory 204 is updated to reflect the departure and the vehicle status is changed from "at a planned stop" to "enroute." If no other planned stops remain in the destination information, i.e., vehicle 108 has traveled to all planned stops in the destination information, upon detection of the departure, the vehicle status is changed from "at a planned stop" to "unassigned." Other actions taken by processor 206 may include sending an alert to I/O device 214 indicating to a vehicle occupant that a departure from a planned stop has been determined, and a description of the planned stop. For example, processor 206 may send an alert to I/O device 214 indicating to a vehicle occupant that a departure from an unplanned stop has been determined. Other information may be conveyed as well, such as the estimated departure time, the estimated position of the unplanned stop, etc. Alternatively, or in addition, a message may be transmitted automatically to dispatch center 102 alerting fleet management of the departure of vehicle 108 from the planned stop and any details associated therewith. In another embodiment, an automated message is not sent until a vehicle occupant has given authorization for the automatic message to be transmitted using I/O device 214. In another embodiment, the vehicle occupant, in response to an alert sent from processor 206 to I/O device 214, transmits a user-generated message using MCT 202 to fleet management, informing them of the precise details of the departure, for example, the time of the departure, the location of the planned stop, or a description of the goods being pickup up or delivered.

If processor 206 has incorrectly determined a departure from a planned stop, for example the vehicle has not yet departed from a planned stop, the vehicle occupant can choose to ignore the indication. In the exemplary embodiment, if no response is entered by the vehicle occupant within a predetermined amount of time, processor 206 can automatically send a message to dispatch center 102 alerting it to the departure and providing pertinent details of the departure, such as the vehicle location at the time the departure was estimated, a description of which planned stop vehicle 108 is departing from, and the estimated time of departure. In yet another embodiment, an automated log, located onboard vehicle 108, remotely at NMF 104, or at dispatch center 102, can be updated with the departure information.

The present invention also allows for the detection of vehicle arrivals and departures from unplanned stops, i.e., stops not identified as a planned stop by the destination information. As explained previously, unplanned stops may be defined as fuel stops, rest stops, overnight stops, and traffic delays, among others.

Figure 5:
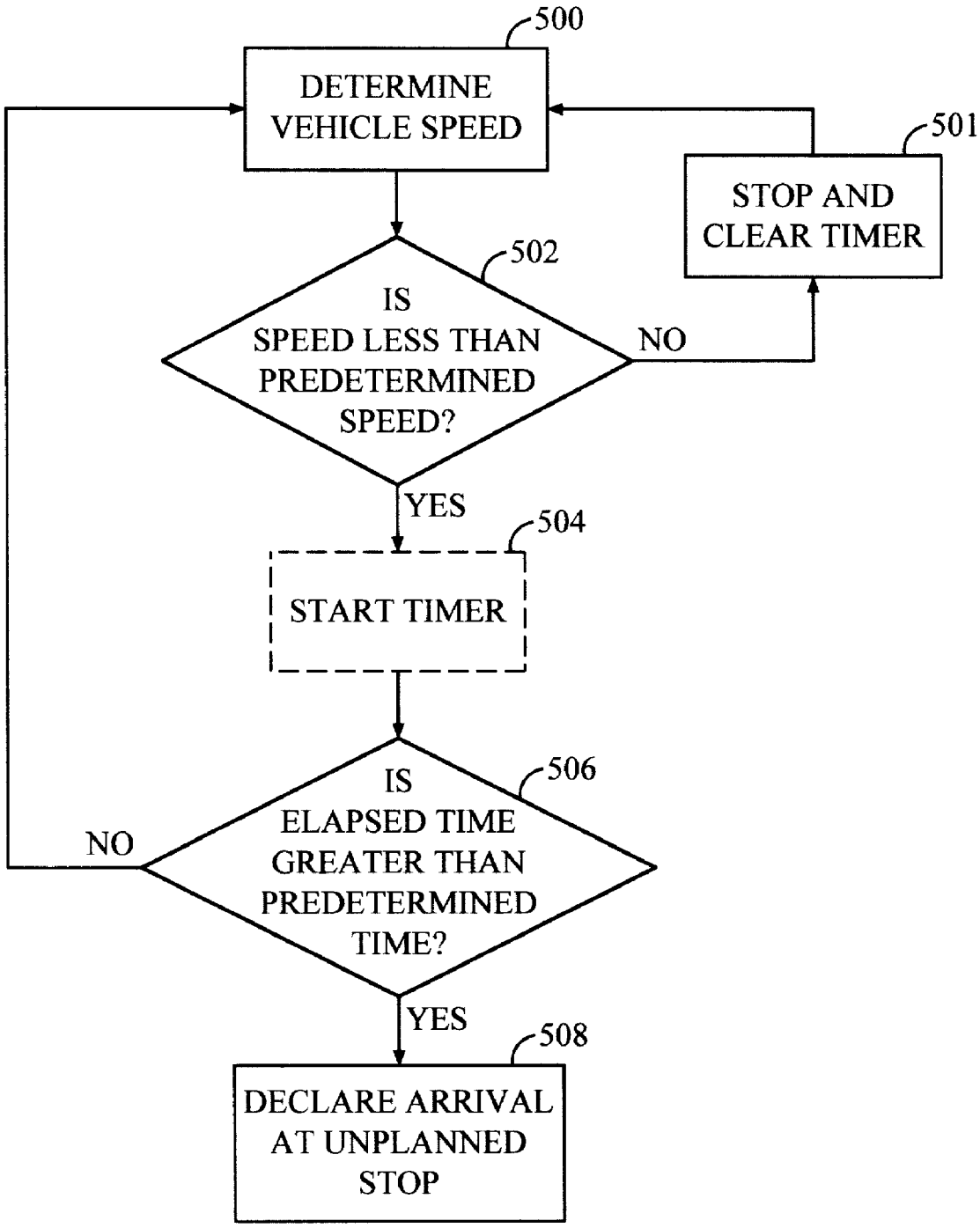
FIG. 5 is a flow diagram illustrating the steps that are performed to determine if a vehicle has arrived at an unplanned stop.

FIG. 5 is a flow diagram illustrating the process that processor 206 performs when determining whether or not vehicle 108 has stopped at an unplanned stop. In the exemplary embodiment, the steps of FIG. 5 are performed whenever there are planned stops yet to be visited remaining in the destination information, including when the vehicle is in the "at a planned stop" state. However, in an alternative embodiment, the steps of FIG. 5 can be performed whether or not there are planned stops remaining or while vehicle 108 is in other vehicle states as well.

In step 500, processor 206 receives vehicle speed information from speedometer 210. Alternatively, a signal indicative of the current vehicle speed is provided to processor 206 from speedometer 210 in response to one or more predefined events. In step 502, the current vehicle speed is compared against a predetermined speed to determine if vehicle 108 has stopped. If the vehicle speed is greater than the predetermined speed, timer 208 is halted and cleared in step 501 if it had previously been activated. Timer 208 is used to determine how long the vehicle speed remains below the predetermined speed. Steps 500, 502, and 501 are then repeated until the vehicle speed is less than the predetermined speed.

The predetermined speed is a variable that is stored in memory 204 and can be modified locally or remotely, as explained above. The predetermined speed for determining whether or not vehicle 108 has made an unplanned stop can be the same predetermined speed variable used to determine whether or not vehicle 108 has arrived at a planned stop, or not. In the exemplary embodiment, the predetermined speed used in step 502 is a different variable than the predetermined speed to determine vehicle arrivals at planned stops, and is equal to zero miles per hour.

When the vehicle speed is equal to or less than the predetermined speed, timer 208 is started, or cleared and restarted, in step 504. The purpose of timer 208 is to measure the elapsed time that the vehicle speed remains equal to or less than the predetermined speed so that a brief slowing or stopping of vehicle 108 does not trigger a false determination of whether or not the vehicle has actually made an unplanned stop.

The elapsed time is compared against a predetermined time in step 506. The predetermined time is a variable which is stored in memory 204 and is programmable locally or remotely, as explained above. The predetermined time variable used in step 506 may be the same variable used in other calculations, or a different variable may be used. In the exemplary embodiment, a unique variable is used for the predetermined time of step 506, and is initially set to five minutes.

If the elapsed time is not greater than the predetermined time of step 506, steps 500 through 506 are repeated until either a new vehicle state is determined, or the speed of vehicle 108 remains less than or equal to the predetermined speed for the predetermined amount of time in step 506. It should be understood that step 504 is performed only once and timer 208 reset only when step 502 fails, i.e., the vehicle speed is greater than the predetermined speed. If the elapsed time is equal to or exceeds the predetermined time in step 506, vehicle 108 is declared to be stopped at an unplanned stop in step 508.

In step 508, processor 206 assigns an "at an unplanned stop" state to vehicle 108, and stores the vehicle state in memory 204. In addition, processor 206 may perform one or more other actions in response to the determination. For example, processor 206 may send an alert to I/O device 214 indicating to a vehicle occupant that an arrival at an unplanned stop has been determined. Other information may be conveyed as well, such as the estimated arrival time or the estimated position of the unplanned stop. Alternatively, or in addition, a message may be transmitted automatically to dispatch center 102 alerting fleet management of the unplanned stop and any details associated therewith. In another embodiment, an automated message is not sent until a vehicle occupant has given authorization for the automatic message to be transmitted using I/O device 214. In another embodiment, the vehicle occupant, in response to an alert sent from processor 206 to I/O device 214, transmits a user-generated message using MCT 202 to fleet management, informing them of the precise details of the stop, for example, the time of the stop, the location of the stop, or the reason for the stop.

If processor 206 has erred in its determination of an unplanned stop, for example if the vehicle is simply delayed in very heavy traffic, the operator can choose to ignore the indication, or to generate an override signal, generally using I/O device 214, to delete any reference to the erroneous unplanned stop determination in memory 204. In yet another embodiment, if no response is entered by the vehicle occupant within a predetermined amount of time after an alert has been presented to I/O device 214, processor 206 sends an message to dispatch center 102 alerting it to the stop and providing pertinent details of the stop, as explained above.

Figure 6:
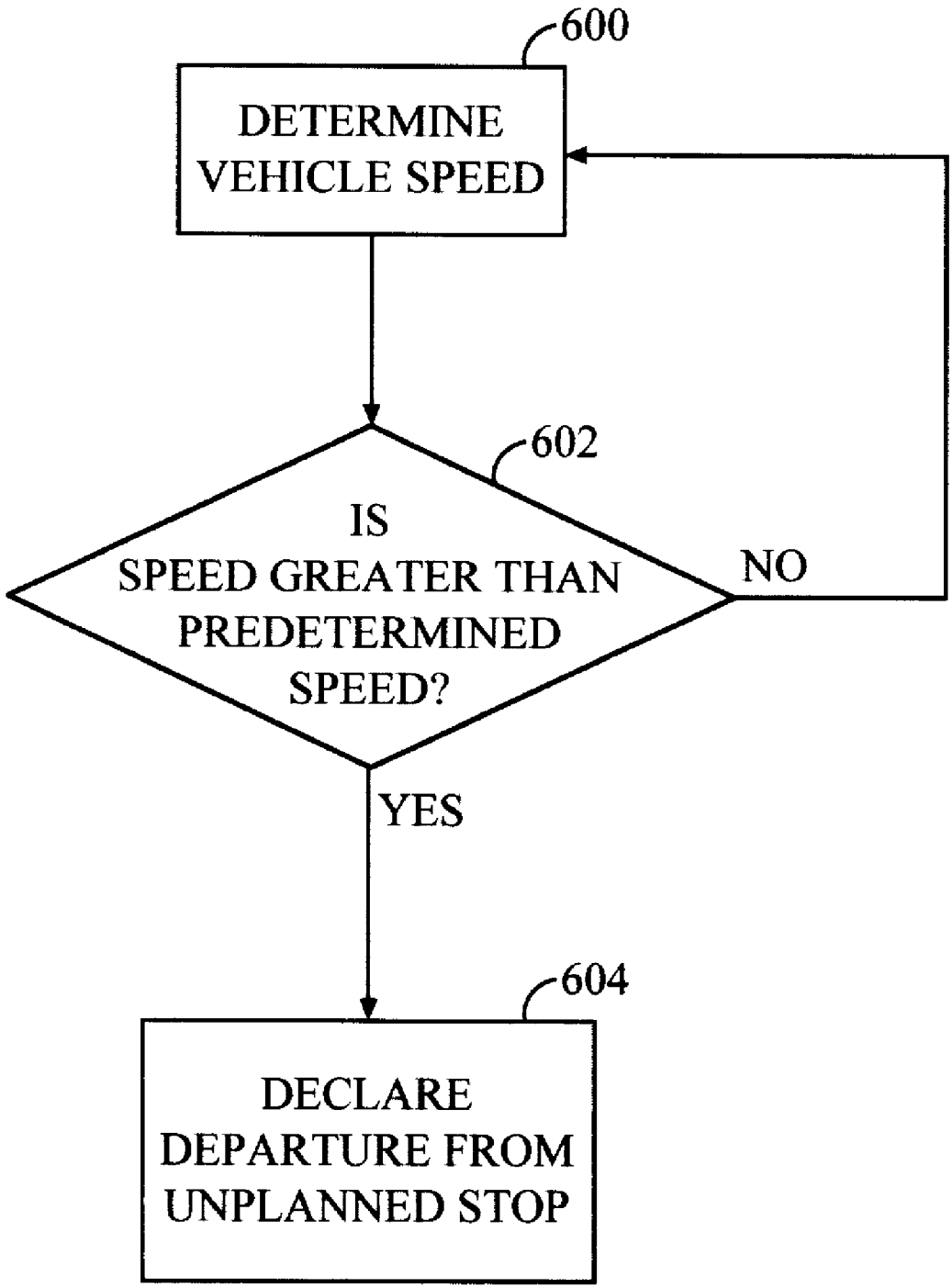
FIG. 6 is a flow diagram illustrating the steps that are performed to determine if a vehicle has departed from an unplanned stop.

FIG. 6 is a flow diagram illustrating the steps that processor 206 performs when determining whether or not vehicle 108 has departed from an unplanned stop. In the exemplary embodiment, the steps of FIG. 6 are only performed when the vehicle is in the "at an unplanned stop" state.

In step 600, processor 206 receives information from speedometer 210 to determine the current speed of vehicle 108. Alternatively, a signal indicative of the current vehicle speed is provided to processor 206 from speedometer 210 in response to a predefined event such the transmission of a message to dispatch center 102. Once the current vehicle speed has been determined, it is compared to a predetermined speed in step 602 to determine if the vehicle is presently moving or not. The predetermined speed is a variable that is stored in memory 204, may be altered locally or remotely as explained above. The predetermined speed variable of step 602 may be the same predetermined speed variable used in other calculations, as explained above, or it may be a different variable. In the exemplary embodiment, a different predetermined speed variable is used in step 602 to determine whether or not vehicle 108 has departed from an unplanned stop. If the current vehicle speed is greater than the predetermined speed of step 602, the vehicle is determined to be moving and step 604 is performed next. If the current vehicle speed is not greater than the predetermined speed of step 602, steps 600 and 602 are repeated until either a new vehicle state is determined or the vehicle speed exceeds the predetermined speed of step 602. When the vehicle speed exceeds the predetermined speed, the vehicle is deemed to be departing from the unplanned stop, and step 604 is performed.

In step 604, processor 206 assigns the "enroute" status to vehicle 108 and stores this status in memory 204. In addition, processor 206 may perform one or more other actions in response to the determination. For example, processor 206 may send an alert to I/O device 214 indicating to a vehicle occupant that a departure from an unplanned stop has been determined. Other information may be conveyed as well, such as the estimated departure time, the estimated position of the unplanned stop, etc. Alternatively, or in addition, a message may be transmitted automatically to dispatch center 102 alerting fleet management of the departure of vehicle 108 from the unplanned stop and any details associated therewith. In another embodiment, an automated message is not sent until a vehicle occupant has given authorization for the automatic message to be transmitted using I/O device 214. In another embodiment, the vehicle occupant, in response to an alert sent from processor 206 to I/O device 214, transmits a user-generated message using MCT 202 to fleet management, informing them of the precise details of the departure, for example, the time of the departure, the location of the unplanned stop, or the reason for the stop.

If processor 206 has erred in its determination of an unplanned departure, for example if a vehicle operator has simply moved vehicle 108 within a truck stop parking lot, the operator can choose to ignore the indication, or to generate an override signal, generally using I/O device 214, to delete any reference to the erroneous departure determination in memory 204. In yet another embodiment, if no response is entered by the vehicle occupant within a predetermined amount of time after the alert has been presented to I/O device 214, processor 206 sends an message to dispatch center 102 alerting it to the departure, and provides pertinent details of the stop, as explained above.

The previous description of the preferred embodiments is provided to enable any person skilled in the art to make or use the present invention. Various modifications to these embodiments will be readily apparent to those skilled in the art, and the generic principles defined herein may be applied to other embodiments without the use of the inventive faculty. Thus, the present invention is not intended to be limited to the embodiments shown herein but is to be accorded the widest scope consistent with the principles and novel features disclosed herein.

We claim:

1. A method for detecting when a vehicle has arrived at a planned stop, comprising the steps of:

determining a vehicle speed and comparing said vehicle speed to a predetermined speed;

determining a vehicle position and comparing said vehicle position to at least one planned stop position; and generating an indication of a vehicle arrival at one of said planned stops when said vehicle speed is less than said predetermined speed for a predetermined amount of time and said vehicle position is less than a predetermined distance from one of said planned stops.

2. A method for detecting when a vehicle has departed from a planned stop, comprising the steps of:

determining that said vehicle has arrived at a planned stop;

determining a vehicle speed and comparing said vehicle speed to a predetermined speed;

determining a vehicle position and comparing said vehicle position to a position corresponding to said planned stop; and generating an indication of a vehicle departure from said planned stop when said vehicle speed is greater than said predetermined speed and said vehicle position is greater than a predetermined distance from said planned stop.

3. A method for detecting when a vehicle has arrived at an unplanned stop, comprising the steps of:

determining a vehicle speed and comparing said vehicle speed to a predetermined speed;

determining whether or not said vehicle is at a planned stop; and generating an indication of a vehicle arrival at said unplanned stop when said vehicle speed is less than said predetermined speed for a predetermined amount of time and when said vehicle is not at a planned stop.

4. A method for detecting when a vehicle has departed from an unplanned stop, comprising the steps of:

determining that said vehicle has arrived at said unplanned stop;

determining a vehicle speed and comparing said vehicle speed to a predetermined speed; and generating an indication of a vehicle departure from said unplanned stop when said vehicle speed is greater than said predetermined speed.

5. An apparatus for detecting when a vehicle has arrived or departed from a planned or unplanned stop, comprising:

a mobile communication terminal onboard said vehicle for receiving destination information;

a speedometer onboard said vehicle for determining a speed of said vehicle;

a position sensor onboard said vehicle for determining a position of said vehicle;

a timer for measuring an elapsed time;

a memory for storing said destination information; and a processor, connected to said mobile communication terminal, said speedometer, said position sensor, said timer, and said memory, said processor for determining a vehicle arrival or a vehicle departure from a planned or an unplanned stop using said destination information, said vehicle speed, said vehicle position, and said elapsed time.

6. The apparatus of claim 5, further comprising:

an I/O device, connected to said processor, for displaying vehicle status information to a vehicle occupant, including said vehicle arrival and vehicle departure information, and for receiving information from a vehicle occupant.

* * * * *